US007999187B2

(12) United States Patent
Isobe et al.

(10) Patent No.: US 7,999,187 B2
(45) Date of Patent: Aug. 16, 2011

(54) PLATED FLAT CONDUCTOR AND FLEXIBLE FLAT CABLE THEREWITH

(75) Inventors: Yoshiyasu Isobe, Chiba (JP); Kunihiro Naoe, Koto-ku (JP)

(73) Assignee: Fujikura Ltd., Tokyo (JP)

( * ) Notice: Subject to any disclaimer, the term of this patent is extended or adjusted under 35 U.S.C. 154(b) by 64 days.

(21) Appl. No.: 12/409,350

(22) Filed: Mar. 23, 2009

(65) Prior Publication Data

US 2009/0236123 A1 Sep. 24, 2009

(30) Foreign Application Priority Data

Mar. 24, 2008 (JP) ..... 2008-075365

(51) Int. Cl.
*H01B 7/08* (2006.01)

(52) U.S. Cl. ..... 174/117 F; 174/126.2

(58) Field of Classification Search ..... 174/117 F, 174/126.1, 126.2
See application file for complete search history.

(56) References Cited

U.S. PATENT DOCUMENTS

| | | | |
|---|---|---|---|
| 2,742,687 A | 4/1956 | Ruemmler | |
| 4,093,466 A | 6/1978 | Davis | |
| 4,263,106 A | 4/1981 | Kohl | |
| 4,331,518 A | 5/1982 | Wilson | |
| 4,749,626 A | 6/1988 | Kadija et al. | |
| 6,040,067 A | 3/2000 | Sugawara et al. | |
| 6,312,762 B1 | 11/2001 | Sugawara et al. | |
| 7,491,897 B2 | 2/2009 | Watanabe et al. | |
| 2007/0256856 A1* | 11/2007 | Ichikawa et al. | 174/257 |

FOREIGN PATENT DOCUMENTS

| | | |
|---|---|---|
| EP | 1026287 A | 8/2000 |
| EP | 1784064 A | 5/2007 |
| JP | 3014814 A | 1/1991 |
| JP | 5033187 A | 2/1993 |
| JP | 10050774 A | 2/1998 |
| JP | 10302867 A | 11/1998 |
| JP | 11111422 A | 4/1999 |
| JP | 11135226 A | 5/1999 |
| JP | 11189894 A | 7/1999 |
| JP | 11343594 A | 12/1999 |
| JP | 2001026898 A | 1/2001 |
| JP | 2001144145 A | 5/2001 |

(Continued)

OTHER PUBLICATIONS

S. M. Arnold, "Repressing the Growth of Tin Whiskers," Plating, Jan. 1966, pp. 96-99.

(Continued)

*Primary Examiner* — Chau N Nguyen
(74) *Attorney, Agent, or Firm* — Sughrue Mion, PLLC

(57) ABSTRACT

Disclosed is a plated flat conductor including a flat conductor of copper or a copper alloy and a plated layer formed on a surface of the flat conductor. The plated layer includes a first intermetallic compound layer of $Cu_3Sn$ disposed on the surface of the flat conductor, a second intermetallic compound layer of $Cu_6Sn_5$ formed on the first intermetallic compound, and a superficial layer formed on the second intermetallic compound layer. The superficial layer is plating material of pure tin or a tin alloy and has an average thickness from about 0.3 μm to 1.0 μm and a maximum thickness of about 1.0 μm or less. A volume ratio of the second intermetallic compound layer to the first intermetallic compound layer is about 1.5 or more.

6 Claims, 1 Drawing Sheet

FOREIGN PATENT DOCUMENTS

| | | | | |
|---|---|---|---|---|
| JP | 2002069688 | A | | 3/2002 |
| JP | 2002080993 | A | | 3/2002 |
| JP | 2002226982 | A | | 8/2002 |
| JP | 2005-243345 | A | | 9/2005 |
| JP | 2006-127939 | A | | 5/2006 |
| JP | 2006-319269 | A | | 11/2006 |
| WO | WO 2006/006534 | | * | 1/2006 |
| WO | 2006/062126 | A1 | | 6/2006 |

OTHER PUBLICATIONS

S. C. Britton, "Spontaneous Growth of Whiskers on Tin Coatings: 20 Years of Observation," Transactions of the Institute of Metal Finishing, 1974, pp. 95-102, vol. 52.

European Patent Office, "Communication Pursuant to Article 94(3) EPC," issued in connection with European Patent Application No. 05 758 244.7, on Nov. 4, 2010.

United States Patent and Trademark Office, "Non-Final Office Action," issued in connection with U.S. Appl. No. 11/571,821, on Apr. 2, 2010.

United States Patent and Trademark Office, "Notice of Allowance," issued in connection with U.S. Appl. No. 11/571,821, on Sep. 23, 2010.

United States Patent and Trademark Office, "Notice of Allowance," issued in connection with U.S. Appl. No. 11/571,821, on Dec. 28, 2010.

English language Translation of "Notification of First Office Action," issued by the State Intellectual Property of the People's Republic of China in connection with Chinese Patent Application No. 200910130202.7, dated Sep. 13, 2010, English language Translation.

English and Japanese language Translations of "Notice of Rejection Reasons," issued in connection with Korean Patent Application No. 10-2009-0023748, dated Oct. 20, 2010, English language Translation.

* cited by examiner

PLATED FLAT CONDUCTOR AND FLEXIBLE FLAT CABLE THEREWITH

CROSS-REFERENCE TO RELATED APPLICATIONS

This application claims priority from Japanese Patent Application No. 2008-075365 filed on Mar. 24, 2008; the entire contents of which are incorporated herein by reference.

BACKGROUND OF THE INVENTION

1. Field of the Invention

Materials and devices consistent with the present invention relate to plated flat conductors and flexible flat cables therewith applied to electronic devices.

2. Description of the Related Art

Compact electronic devices such as mobile phones, digital cameras, CD players, ink-jet printers and the like require compact and flexible wiring means. Flexible flat cables are frequently used for such purposes. A flexible flat cable is generally provided with a plurality of flat conductors arranged in parallel and covered with thin insulator films. Ends of the flat conductors are led out of the insulator films, and these ends are applied to electrical connections. For the purpose of reduction of electrical contact resistance and/or improvement of quality of soldering, the flat conductors are often subject to tinning (plating with pure tin or any tin alloy).

Although it is desired to avoid the use of lead in view of environmental protection, tin and tin alloys free from lead are known to cause growth of a "crystal whisker" (or "whisker" in short, which is a single crystal grown in a filamentary form) therefrom during use after production. The whiskers can grow in a very long form (100 μm or longer, for example) relative to distances among conductors in such down-sized electronic devices. If whiskers grow from plated flat conductors embedded in a flexible flat cable, some problems, such as short circuits, for example, may occur.

SUMMARY OF THE INVENTION

Certain exemplary embodiments of the present invention provide a plated flat conductor and a flexible flat cable therewith, which suppress growth of a whisker while a conductor therein is plated with tin or a tin alloy.

According to an exemplary embodiment of the present invention, a plated flat conductor includes a flat conductor of copper or a copper alloy; and a plated layer formed on a surface of the flat conductor. The plated layer includes a first intermetallic compound layer of $Cu_3Sn$ on the surface of the flat conductor, a second intermetallic compound layer of $Cu_6Sn_5$ formed on the first intermetallic compound, and a superficial layer formed on the second intermetallic compound layer. The superficial layer is a plating material of pure tin or a tin alloy and has an average thickness from about 0.3 μm to 1.0 μm and a maximum thickness of about 1.0 μm or less. A volume ratio of the second intermetallic compound layer to the first intermetallic compound layer is about 1.5 or more.

According to a second exemplary embodiment of the present invention, a flexible flat cable includes a plurality of plated flat conductors of the first exemplary embodiment and an insulator film covering the conductors.

DETAILED DESCRIPTION OF THE EXEMPLARY EMBODIMENTS

An exemplary embodiment of the present invention will be described hereinafter with reference to the appended drawings.

Figure 1:
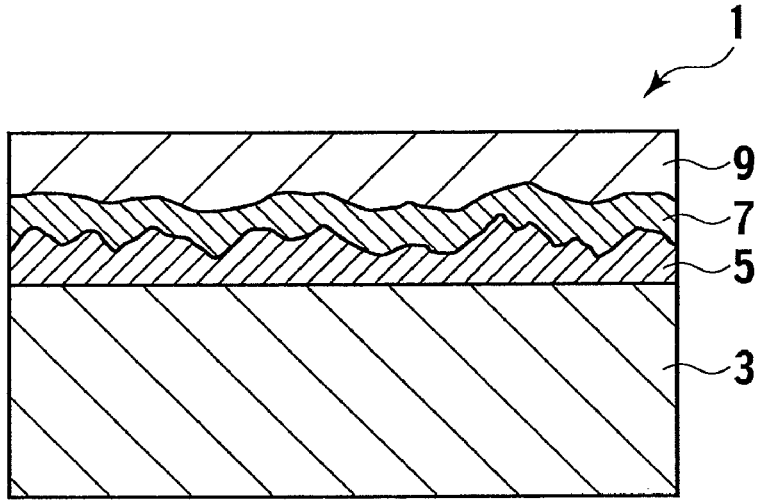
FIG. 1 is a cross sectional view of a plated flat conductor in accordance with an exemplary embodiment of the present invention.

To produce a plated flat conductor 1 shown in FIG. 1, a copper wire produced by a drawing process from a copper ingot may be used. However, instead of copper, any of copper alloys such as phosphor bronze may be applied thereto. The copper wire is produced to have an applicable dimension, such as 0.8 mm in diameter for example.

The copper wire is plated with pure tin or any tin alloy selected from the group of tin-copper alloys, tin-silver alloys, and tin-bismuth alloys. This plating may be executed by, but not limited to, an ordinary tin electrolytic plating method. By regulating current density, time, and any other conditions, the thickness of the plated layer can be appropriately regulated in view of a thickness desired for an intermediate product just after rolling, while an example of the thickness is 10 μm.

The plated copper wire is drawn to form a thin wire having a diameter from 0.1 mm to 0.2 mm, for example. The thin wire is further subject to a rolling process: thereby a flat conductor 3 with tin plated thereon is obtained. In this state, although its thickness is reduced and consequently a microstructure thereof is deformed, the other properties are generally not changed.

The flat conductor 3 with plated tin is subject to a heat treatment in a non-oxidizing atmosphere, such as inert gas produced by a proper furnace, so reaction at the interface between tin (or a tin alloy) and copper (or a copper alloy) is promoted to form intermetallic compounds in the plated layer.

The intermetallic compounds include $Cu_6Sn_5$ and $Cu_3Sn$. $Cu_6Sn_5$ may be first generated at the interface and grows in a form of a layer toward the surface of the plated layer. $Cu_3Sn$ may be next generated at another interface between the growing $Cu_6Sn_5$ layer and the copper conductor, and also grows in a form of a layer to follow the growth of the $Cu_6Sn_5$ layer.

As a result, the plated layer is composed of three distinct layers 5, 7, 9 as shown in FIG. 1. Namely, a superficial layer 9 is unreacted tin, an "A" phase forming the layer 7 next to the superficial layer 9 is an intermetallic compound of $Cu_6Sn_5$, and a "B" phase forming the layer 5 at the bottom (on the interface with the copper conductor) is another intermetallic compound of $Cu_3Sn$. In general, the A phase 7 has a relatively smooth surface, whereas the B phase 5 has a relatively rough surface.

Referring to these layers in a reverse order, the plated layer formed on the surface of the flat conductor 3 is comprised of: the first intermetallic compound layer 5 of $Cu_3Sn$ (the B phase) just on the surface of the flat conductor 3, the second intermetallic compound layer 7 including $Cu_6Sn_5$ (the A phase) formed on the first intermetallic compound 5, and the superficial layer 9 of tin or a tin alloy formed on the second intermetallic compound layer 7.

Growth of these intermetallic compound layers can be controlled by means of controllable parameters of the heat treatment, such as time and temperature in relation to initial thickness of the plated layer. Proper growth control is one of keys included in the inventive concept. When the intermetallic compound layers overly grow, the roughness of the growing surface of the B phase gets greater and consequently the B phase tends to project out of the A phase toward the tin layer. It leads to nonuniformity of thickness of the tin layer and generation of internal stress therein, which may cause growth of a whisker from a relatively thick portion of the tin layer. In contrast, insufficient growth of the intermetallic compound layers results in leaving a great amount of tin unreacted. The unreacted tin supplies a source of the whisker to promote growth thereof. Therefore, a plated layer with properly controlled intermetallic compounds provides a result of suppression of whisker growth. The structure of the plated layer affects the other properties of the plated conductor, such as electrical contact resistance, resistance against bending, and the like. In view of these properties, exemplary structural parameters of the plated layer will be provided in the following descriptions in more detail.

The superficial layer 9 of the unreacted tin or tin alloy is may be 1.0 μm or less in thickness because a thinner tin layer suppresses growth of a whisker. In contrast, very small thicknesses down to 0.3 μm or less may cause an increase in electrical contact resistance provided by the superficial layer 9. Therefore, the superficial layer 9 may have an exemplary average thickness from about 0.3 μm to 1.0 μm and a maximum thickness of about 1.0 μm or less.

A volume ratio of the second intermetallic compound of the A phase to the first intermetallic compound of the B phase may be 1.5 or more. One of the reasons is that an greatly grown B phase causes growth of a whisker from a thick portion of the tin layer as discussed above. The volume ratio may also be 3.0 or less, because exemplary volume ratios below 3.0 are advantageous in view of resistance of the plated layer against bending.

Roughness of the interface between the second intermetallic compound layer 7 of the A phase and the superficial layer 9 may be 150 nm or less on average. The low roughness decreases chances of whisker growth.

Figure 2:
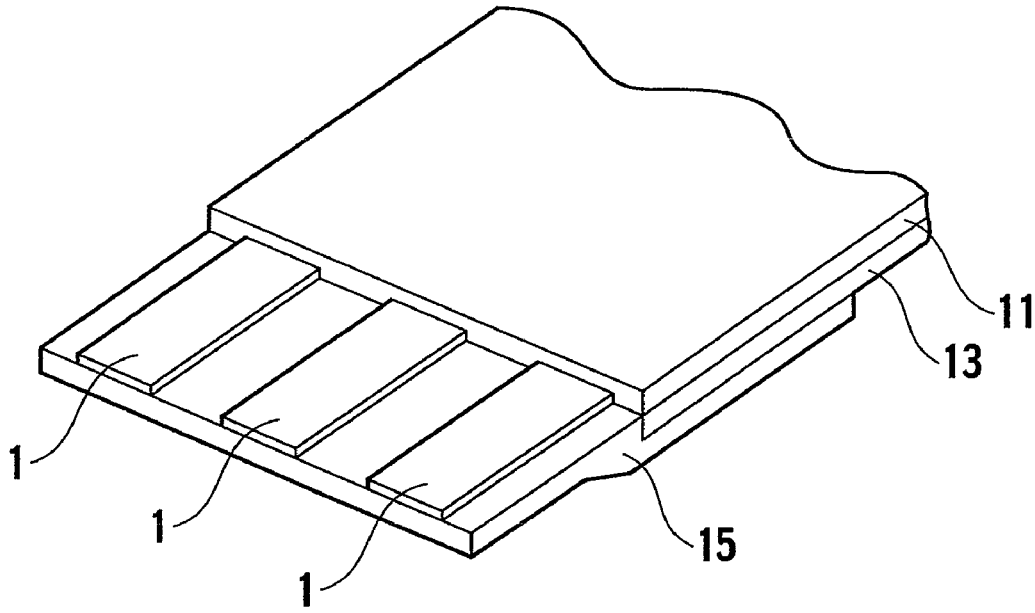
FIG. 2 is an elevational perspective view of a flexible flat cable in accordance with an exemplary embodiment of the present invention.

Referring to FIG. 2, the plated flat conductor 1 as described above may be applied to a flexible flat cable. In one embodiment, a plurality of plated flat conductors 1 are arranged in parallel and covered with a pair of insulator films 11, 13 adhered together. Ends of the plated flat conductors 1 are led out of the insulator films 11, 13 and may be protected by a protector plate 15 adhered to one side of the cable. The exposed ends of the conductors 1 serve as terminals for electrical contact with a connector of an external device.

EXAMPLES

Test results described hereinafter demonstrate beneficial effects of the present exemplary embodiment. Test pieces are formed from soft copper wires of 0.8 mm in diameter. The copper wires are plated with pure tin so as to have a pure tin plated layer having a thickness of 10 μm. The plated wires are drawn to form thin wires having a diameter of 0.12 mm and further subject to rolling, thereby flat conductors with tin plated layers having a thickness of 0.035 mm are obtained. Heat treatments in various conditions are respectively executed on the flat conductors, thereby test pieces (examples 1-36 and C1-C9) are obtained. Meanwhile, tin-1% silver is applied to plated layers of some test pieces (examples 37, 39-41 and C10), and a phosphor bronze wire is applied to some test pieces (examples 38, 41, 42 and C11), although the production process of these test pieces is substantially identical to that of the aforementioned test pieces.

In the test results, measurements of thickness and volume, and evaluations as to whether the B phase projects out of the A phase are based on SEM (Scanning Electron Microscope) images of cross sections of the test pieces. Volume ratios of two phases are calculated on the basis of a general knowledge that a volume ratio corresponds to an area ratio of a cross section. Measurements of roughness is based on surface roughness measurements carried out by AFM (Atomic Force Microscope), where superficial layers of tin are chemically removed to expose the A phases and then measurements of these roughness are carried out. The measurement method of average roughness (Ra) conforms to a standard of JIS B0601. Furthermore, flexible flat cables (FFC), each of which includes 40 flat conductors, are produced from the aforementioned test pieces in accordance with the aforementioned production method. The FFCs are respectively applied to a duration test in which terminals are connected with connectors (commercially available as a ZIF type of J.S.T. Mfg. Co., Ltd. treated with a reflowing treatment) at the normal temperatures and humidities (namely, in the ambient air) for 500 hours. After the duration test, whiskers on surfaces of the terminals are observed by means of SEM and the maximum lengths of these are measured. Further, an ordinary U-letter slide-bending test is executed, in which each FFC is bent in a U-letter shape with one end being securely held and another end subjected to reciprocal slides by constant strokes until any of the flat conductors breaks. The cycles taken to break any conductors are counted.

Tables 1-3 summarize the test results. Some results are indicated on a four-grade scale, where A means excellent, B means acceptable, C means not good, and D means bad. With respect to whisker length, maximum lengths of 30 μm or less are evaluated as A, those of 50 μm or less as B, those longer than 50 μm as C, and those around 100 μm or longer as D. A whisker around 30 μm in length may not give rise to problems such as short circuits. While electrical contact resistance is evaluated on a two-grade scale, B means electrical contact resistances smaller than 50 mΩ, which are sufficiently workable, and D means electrical contact resistances of 50 mΩ or greater. With respect to resistance against bending, it is evaluated as A when cycles taken to break conductors reach 4 million or more, and it is evaluated as B when cycles reach 3 million or more. Furthermore, in the "Overall" column, any test pieces having neither C nor D score in any column are indicated as A or B. Among them, test pieces each having two or more A scores are evaluated as A, and test pieces each having only one A score are evaluated as B. Remaining test pieces are evaluated as C or D, depending on these worst scores.

TABLE 1

| | test results | | | | | | | | |
|---|---|---|---|---|---|---|---|---|---|
| | Average thickness of the tin plated layer (μm) | Maximum thickness of the tin plated layer (μm) | Volume ratio of the A phase to the B phase | Roughness of the A phase (nm) | Projection of the B phase | Length of a whisker | Electrical contact resistance | Resistance against bending | Overall |
| 1 | 0.33 | 0.57 | 3.1 | 232 | None | B | B | B | B |
| 2 | 0.55 | 0.78 | 3.4 | 332 | None | B | B | B | B |

TABLE 1-continued

| test results | | | | | | | | | |
|---|---|---|---|---|---|---|---|---|---|
| | Average thickness of the tin plated layer (μm) | Maximum thickness of the tin plated layer (μm) | Volume ratio of the A phase to the B phase | Roughness of the A phase (nm) | Projection of the B phase | Length of a whisker | Electrical contact resistance | Resistance against bending | Overall |
| 3 | 0.76 | 0.95 | 3.8 | 275 | None | B | B | B | B |
| 4 | 0.88 | 1.00 | 3.6 | 349 | None | B | B | B | B |
| 5 | 0.43 | 0.68 | 1.5 | 297 | None | B | B | A | B |
| 6 | 0.30 | 0.52 | 2.5 | 312 | None | B | B | A | B |
| 7 | 0.62 | 0.78 | 1.5 | 342 | None | B | B | A | B |
| 8 | 0.62 | 0.78 | 2.1 | 256 | None | B | B | A | B |
| 9 | 0.70 | 0.88 | 2.1 | 284 | None | B | B | A | B |
| 10 | 0.81 | 0.95 | 2.1 | 336 | None | B | B | A | B |
| 11 | 0.62 | 0.78 | 3.0 | 263 | None | B | B | A | B |
| 12 | 0.70 | 0.88 | 3.0 | 347 | None | B | B | A | B |
| 13 | 0.90 | 1.00 | 2.5 | 276 | None | B | B | A | B |
| 14 | 0.55 | 0.77 | 3.2 | 143 | None | A | B | B | B |
| 15 | 0.62 | 0.78 | 3.2 | 125 | None | A | B | B | B |
| 16 | 0.86 | 1.00 | 3.2 | 120 | None | A | B | B | B |
| 17 | 0.86 | 1.00 | 4.2 | 110 | None | A | B | B | B |
| 18 | 0.30 | 0.52 | 1.5 | 144 | None | A | B | A | A |
| 19 | 0.43 | 0.68 | 1.5 | 121 | None | A | B | A | A |
| 20 | 0.45 | 0.62 | 2.1 | 138 | None | A | B | A | A |
| 21 | 0.30 | 0.53 | 2.5 | 142 | None | A | B | A | A |
| 22 | 0.48 | 0.67 | 2.5 | 150 | None | A | B | A | A |
| 23 | 0.30 | 0.52 | 3.0 | 149 | None | A | B | A | A |
| 24 | 0.62 | 0.78 | 1.5 | 126 | None | A | B | A | A |
| 25 | 0.66 | 0.80 | 1.7 | 146 | None | A | B | A | A |
| 26 | 0.70 | 0.88 | 2.1 | 115 | None | A | B | A | A |
| 27 | 0.70 | 0.95 | 2.1 | 127 | None | A | B | A | A |
| 28 | 0.81 | 0.95 | 2.1 | 150 | None | A | B | A | A |
| 29 | 0.62 | 0.78 | 2.5 | 135 | None | A | B | A | A |
| 30 | 0.81 | 0.95 | 2.7 | 128 | None | A | B | A | A |
| 31 | 0.62 | 0.78 | 3.0 | 119 | None | A | B | A | A |
| 32 | 0.70 | 0.88 | 3.0 | 141 | None | A | B | A | A |
| 33 | 0.70 | 0.95 | 3.0 | 150 | None | A | B | A | A |
| 34 | 0.86 | 1.00 | 1.5 | 133 | None | A | B | A | A |
| 35 | 0.91 | 1.00 | 2.1 | 107 | None | A | B | A | A |
| 36 | 0.86 | 1.00 | 2.5 | 121 | None | A | B | A | A |

TABLE 2

| Test results | | | | | | | | | |
|---|---|---|---|---|---|---|---|---|---|
| | Average thickness of the tin plated layer (μm) | Maximum thickness of the tin plated layer (μm) | Volume ratio of the A phase to the B phase | Roughness of the A phase (nm) | Projection of the B phase | Length of a whisker | Electrical contact resistance | Resistance against bending | Overall |
| C1 | 0.30 | 0.52 | 1.1 | 320 | Projecting | C | B | A | C |
| C2 | 0.62 | 0.78 | 1.1 | 319 | Projecting | C | B | A | C |
| C3 | 0.86 | 1.00 | 1.1 | 385 | Projecting | C | B | A | C |
| C4 | 0.95 | 1.20 | 1.7 | 141 | None | C | B | A | C |
| C5 | 0.95 | 1.20 | 2.7 | 118 | None | C | B | A | C |
| C6 | 0.15 | 0.28 | 2.5 | 147 | None | A | D | A | D |
| C7 | 0.29 | 0.46 | 1.7 | 136 | None | A | D | A | D |
| C8 | 0.29 | 0.46 | 2.7 | 144 | None | A | D | A | D |
| C9 | 1.16 | 1.45 | 1.6 | 130 | None | D | B | A | D |

TABLE 3

Test results

| | Conductor | Plated layer | Average thickness of the tin plated layer (μm) | Maximum thickness of the tin plated layer (μm) | Volume ratio of the A phase to the B phase | Roughness of the A phase (nm) | Projection of the B phase | Length of a whisker | Electrical contact resistance | Resistance against bending | Overall |
|---|---|---|---|---|---|---|---|---|---|---|---|
| 37 | Pure copper | Tin-1% silver | 0.30 | 0.62 | 2.1 | 276 | None | B | B | A | B |
| 38 | Phosphor-bronze | Pure tin | 0.30 | 0.51 | 2.1 | 231 | None | B | B | A | B |
| 39 | Pure copper | Tin-1% silver | 0.30 | 0.55 | 3.0 | 124 | None | A | B | A | A |
| 40 | Pure copper | Tin-1% silver | 0.77 | 1.00 | 1.5 | 144 | None | A | B | A | A |
| 41 | Phosphor-bronze | Tin-1% silver | 0.30 | 0.62 | 3.0 | 136 | None | A | B | A | A |
| 42 | Phosphor-bronze | Pure tin | 0.86 | 1.00 | 1.5 | 145 | None | A | B | A | A |
| C10 | Pure copper | Tin-1% silver | 0.30 | 0.65 | 1.1 | 385 | Projecting | C | B | A | C |
| C11 | Phosphor-bronze | Pure tin | 0.30 | 0.57 | 1.1 | 297 | Projecting | C | B | A | C |

Test pieces 1-42 satisfy a condition in which an average thickness of the superficial layer of tin (or tin-alloy) falls within a range from 0.3 μm to 1.0 μm, a maximum thickness thereof falls within a range of 1.0 μm or less, and a volume ratio of the A phase to the B phase falls within a ratio of 1.5 or more, simultaneously. Moreover, these test pieces 1-42 are free from the B phase projecting out of the A phase. These test pieces 1-42 commonly show sufficient suppression of whisker length (A or B). These results are asserted to be beneficial in view of prevention of short circuits. Furthermore, these results are asserted to be unexpected as general knowledge teaches that whiskers generated from plated tin free from lead may grow up to 100 μm or longer.

Among the aforementioned test pieces 1-42, those satisfying a condition in which roughness of an interface between the A phase (second intermetallic compound) layer and the superficial layer falls within a range of 150 nm or less (test pieces 14-36 and 39-42) show more effective suppression of whisker length, as these lengths are further reduced down to 30 nm or less. Therefore, roughness in the range of 150 nm or less also provides more beneficial and unexpected results.

Among the aforementioned test pieces 1-42, those satisfying a condition in which a volume ratio of the A phase to the B phase falls within a range from 1.5 to 3.0 (test pieces 5-13, 18-42) are superior in resistance against bending. Therefore, volume ratios in the range from 1.5 to 3.0 also provide beneficial and unexpected results.

Furthermore, test pieces 37-42 use either or both of phosphor-bronze and tin-1% silver instead of copper as a conductor and pure tin as a plated layer. These test pieces also provide beneficial results with respect to the test pieces 1-36.

In contrast, the structural parameters of the test pieces C1-C11 are out of the aforementioned range. Some of properties are insufficient (C or D), therefore the overall scores thereof are C or D.

Although the invention has been described above by reference to certain exemplary embodiments of the invention, the invention is not limited to the exemplary embodiments described above. Modifications and variations of the embodiments described above will occur to those skilled in the art, in light of the above teachings.

What is claimed is:

1. A plated flat conductor comprising:

a flat conductor comprising a conductive material selected from a group consisting of copper and copper alloys; and a plated layer formed on a surface of the flat conductor comprising:

a first intermetallic compound layer comprising $Cu_3Sn$ formed on the surface of the flat conductor, a second intermetallic compound layer comprising $Cu_6Sn_5$ formed on the first intermetallic compound, and a superficial layer formed on the second intermetallic compound layer, the superficial layer comprising a plating material, selected from a group consisting of pure tin and tin alloys, and the superficial layer having an average thickness from about 0.3 μm to 1.0 μm and a maximum thickness of about 1.0 μm or less, wherein a volume ratio of the second intermetallic compound layer to the first intermetallic compound layer is about 1.5 or more, and wherein an average of a roughness of an interface between the second intermetallic compound layer and the superficial layer is about 150 nm or less.

2. The plated flat conductor of claim 1, wherein a volume ratio of the second intermetallic compound layer to the first intermetallic compound layer is about 1.5 to 3.0.

3. The plated flat conductor of claim 1, wherein the tin alloys are selected from a group consisting of tin-copper alloys, tin-silver alloys, and tin-bismuth alloys.

4. A flexible flat cable comprising:

a plurality of plated flat conductors disposed in parallel, each of the plated flat conductors comprising:

a flat conductor comprising a conductive material selected from a group consisting of copper and copper alloys; and a plated layer formed on a surface of the flat conductor comprising:

a first intermetallic compound layer comprising $Cu_3Sn$ formed on the surface of the flat conductor, a second intermetallic compound layer comprising $Cu_6Sn_5$ formed on the first intermetallic compound, and a superficial layer formed on the second intermetallic compound layer, the superficial layer comprising a plating material, selected from a group consisting of pure tin and tin alloys, and the superficial layer having an average thickness from about 0.3 μm to 1.0 μm and a maximum thickness of about 1.0 μm or less, wherein a volume ratio of the second intermetallic compound layer to the first intermetallic compound layer is about 1.5 or more, and an average of a roughness of an interface between the second intermetallic compound layer and the superficial layer is about 150 nm or less; and an insulator film covering the plated flat conductors.

5. The flexible flat cable of claim 4, wherein a volume ratio of the second intermetallic compound layer to the first intermetallic compound layer is about 1.5 to 3.0.

6. The flexible flat cable of claim 4, wherein the tin alloys are selected from a group consisting of tin-copper alloys, tin-silver alloys, and tin-bismuth alloys.

* * * * *